United States Patent [19]

Pacheco et al.

[11] Patent Number: 5,038,810

[45] Date of Patent: Aug. 13, 1991

[54] BOOM OPERATED CHUTE CLEANING DEVICE

[76] Inventors: Daniel Pacheco, P.O. Box 1536; Jerry Andrews, 128 Miha Pl., both of Kihei, Hi. 96753

[21] Appl. No.: 478,493

[22] Filed: Feb. 12, 1990

[51] Int. Cl.[5] ..... B08B 9/34

[52] U.S. Cl. ..... 134/167 C; 134/179

[58] Field of Search ..... 134/167 R, 167 C, 179, 134/168 C, 169 C; 15/104.05, 104.03, 104.09, 242, 243, 249; 33/302, 304

[56] References Cited

U.S. PATENT DOCUMENTS

| | | | |
|---|---|---|---|
| 2,887,118 | 5/1959 | Loeffler | 134/168 C |
| 3,994,310 | 11/1976 | Brandon | 134/167 C |
| 4,071,919 | 2/1978 | Fields | 134/167 C |
| 4,073,302 | 2/1978 | Jones | 134/167 C |
| 4,212,248 | 7/1980 | Maybury | 33/544 |
| 4,244,524 | 1/1981 | Wellings | 134/167 R |
| 4,518,041 | 5/1985 | Zublin | 134/179 |
| 4,690,159 | 9/1987 | Vadakin et al. | 134/167 C |

FOREIGN PATENT DOCUMENTS

| | | | |
|---|---|---|---|
| 2612811 | 9/1988 | France | 15/104.09 |

*Primary Examiner*—William A. Cuchlinski, Jr.
*Assistant Examiner*—William C. Dowling
*Attorney, Agent, or Firm*—H. Jay Spiegel

[57] ABSTRACT

The present invention relates to a boom operated chute cleaning device including a boom assembly with a reel designed to store and pay out a fluid conduit from which is hung a chute cleaning device. The chute cleaning device includes a frame assembly with guide structure designed to guide the travel of the cleaning device within a chute and a rotatable spraying assembly mounted on the frame assembly and supplied with fluid through the fluid conduit. As the chute cleaning device is moved up and down within the chute, fluid pressure supplied through the fluid conduit will flow out the rotatable spraying assembly causing rotation thereof to allow complete cleaning or other treatment of the interior walls of the chute.

5 Claims, 5 Drawing Sheets

BOOM OPERATED CHUTE CLEANING DEVICE

BACKGROUND OF THE INVENTION

The present invention relates to a boom operated chute cleaning device. In the prior art, cleaning devices which use water pressure for cleaning purposes are well known. However, no prior art is known to applicant which teaches all the aspects of the present invention as will be described in greater detail hereinafter.

The following prior art is known to applicant:

U.S. Pat. No. 2,887,118 to Loeffler discloses a pipe cleaning device having guide wheels and a cleaning head designed to direct fluid pressure against the walls of the pipe to clean same. This device differs from the teachings of the present invention as failing to include a boom assembly as disclosed herein or a rotatable spray bar.

U.S. Pat. No. 3,267,504 to Cook et al discloses a pipe cleaning apparatus having a rotatable brush structure as well as means for applying a solvent within the pipe. The present invention differs from the teachings of this patent as being boom operated and including a pressure operated rotatable spray bar.

U.S. Pat. No. 3,994,310 to Brandon discloses a duct cleaning apparatus including a rotatable spray bar moved in a duct by movements of the attached fluid supply line. The present invention differs from the teachings of this patent as including specific details of the boom assembly for carrying the cleaning device as well as including sophisticated guiding structure to accurately and easily guide the cleaning device for centering within the duct which is being cleaned.

U.S. Pat. No. 4,071,919 to Fields et al discloses a waste chute cleaning apparatus which is reciprocated in a chute through the use of a motor operated boom assembly and which includes a vibratory brush structure and a non-rotatable spray head. The present invention is distinct from the teachings of this patent as including a rotatable spray head as well as boom structure different from the structure of the boom device of Fields et al.

U.S. Pat. No. 4,073,302 to Jones discloses a cleaning apparatus for sewer pipes and the like including rails with wheels protruding therethrough to guide the device through a conduit. The nozzle directs fluid streams backward in a way causing the device to be propelled through the conduit. This is different from the teachings of the present invention which includes a spray bar which is rotatable with respect to its supporting frame and a sophisticated boom structure designed to pay out fluid conduit.

U.S. Pat. No. 4,212,428 to Maybury discloses an apparatus and method to reduce interline twisting in a pipeline traversing apparatus with the apparatus including guide wheels designed to position the device within a pipeline and including a plurality of lines which are supported without twisting. The present invention is distinct from the teachings of this patent as showing different guide wheel structure as well as different fluid outlet and support structure.

U.S. Pat. No. 4,518,041 to Zublin discloses a well cleaning assembly including a rotatable nozzle carried on its fluid supply conduit and supported on a reel carrying apparatus. The present invention is distinct from the teachings of this patent as disclosing frame structure and guide structure nowhere taught or suggested therein as well as other differences including boom structure.

USSR Patent No. 379295 to Tugarinov discloses a pipe inner surface cleaning device guided within a pipe by guide wheels and including outlet nozzle structure designed to simultaneously spray cleaning fluid on the walls of the pipe while propelling the device within the pipe. The present invention is distinct from the teachings of this patent as including different nozzle structure, different frame structure and boom support structure nowhere taught or suggested therein.

SUMMARY OF THE INVENTION

The present invention overcomes the deficiencies found in the prior art as described above and provides a new and improved boom operated chute cleaning device which combines simplicity, convenience and effectiveness.

The present invention includes the following interrelated aspects and features:

(a) In a first aspect, the chute cleaning device includes a frame device having attached thereto a rotary spraying assembly. The frame device includes guide structure designed to facilitate the guidance of the chute cleaning device within a chute.

(b) The guide structure includes circumferentially spaced wheels preferably in two rows with some of the wheels being mounted on telescoping supports which may be fixed at predetermined degrees of extension as well as at least one wheel in each row of wheels mounted on a telescoping support which is spring biased in the direction of extension.

(c) The spraying assembly includes an elongated spray bar having outlet nozzles at its ends which are canted in directions causing the spray bar to be rotated when cleaning fluid is sprayed therefrom.

(d) Cleaning fluid is supplied to the spray bar via a coupling for the spray bar and the chute cleaning device is supported and suspended within the chute by a fluid conduit which supplies fluid to the spray bar.

(e) The boom portion of the present invention includes a wheeled cart supporting a drum rotatably mounted thereon, which drum stores and pays out and retrieves the fluid conduit. An electric motor is provided which is interconnected with the drum through suitable gearing to cause the drum to be controllably rotated to either pay out or retrieve fluid conduit.

(f) The fluid conduit is guided by a guiding structure having a series of pulleys thereon designed to guide the fluid conduit into and out of the adjacent chute without kinking or bending.

As such, it is the first object of the present invention to provide an improved boom operated chute cleaning device.

It is further object of the present invention to provide such a boom operated chute cleaning device having a rotatable spray bar supported on a frame device which is guided within a chute.

It is a yet further object of the present invention to provide such a chute cleaning device with an associated boom including conduit guiding structure as well as a controllable drum for storing and paying out and retrieving fluid conduit.

These and other object aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
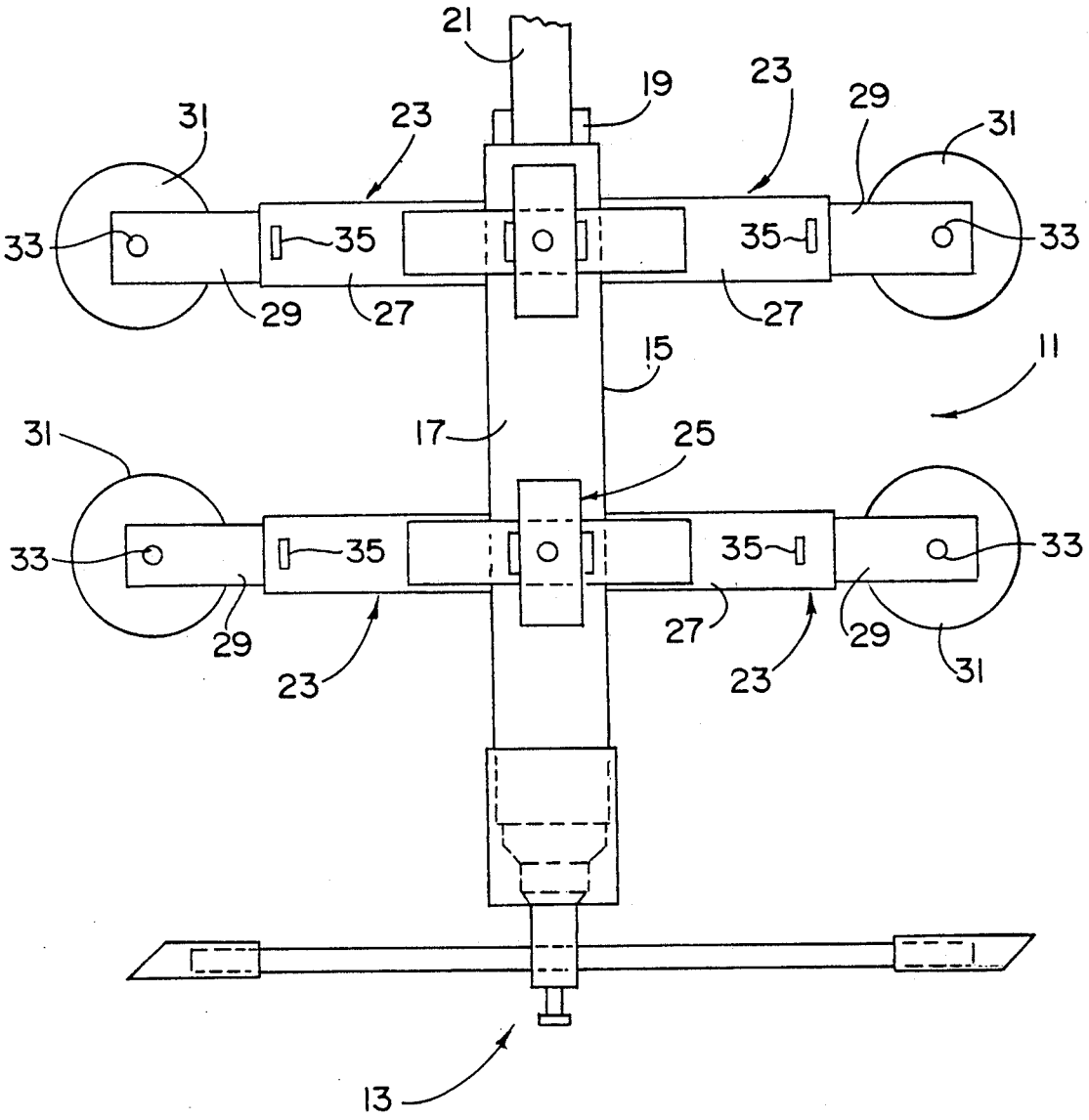
FIG. 1 shows a side view of the chute cleaning device of the present invention.

With reference, first, to FIG. 1, it is seen that the chute cleaning device includes a frame device 11 and a rotatable spraying assembly 13.

The frame device 11 includes a tubular member 15 having a flow conduit 17 extending therethrough and connected at an upper end with a coupling 19 adapted to couple to a fluid conduit 21.

In two rows and circumferentially spaced about the tubular member 15 are a plurality of wheel assemblies. The wheel assemblies 23, best seen in FIG. 1, are substantially identical to one another and the wheel assemblies 25 are better seen in FIGS. 3–5 and are identical to one another.

The wheel assemblies 23 include a first hollow rod 27 in which is slidably received a second elongated rod 29 to which, at its distal end, is mounted a rotatable wheel 31, rotatable about the pivot 33. A threaded opening (not shown) is formed through the wall of the tubular member 27 and a threaded bolt 35 is threadably contained therein. When it is desired to lock the relationship between the tubular members 27 and 29, the bolt 35 is loosened whereupon the tubular member 29 maybe reciprocated with respect to the tubular member 27, and when the desired relationship has been achieved, the bolt 35 may be threaded through the opening and into frictional engagement with the outer walls of the tubular member 29 to maintain the desired relationship.

Figure 3:
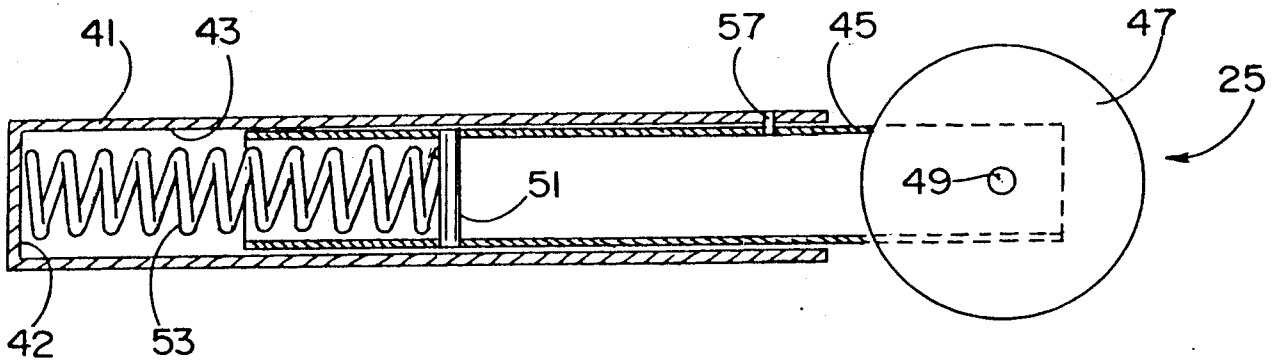
FIG. 3 shows a cross-sectional view of a wheel and support structure shown in FIG. 1.
Figure 4:
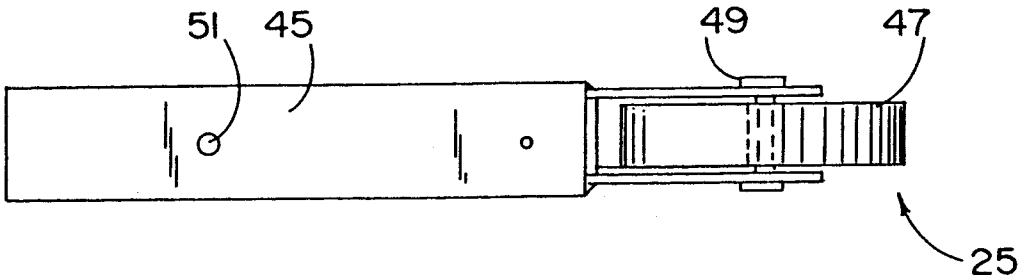
FIG. 4 shows a top view of that which is shown in FIG. 3.
Figure 5:
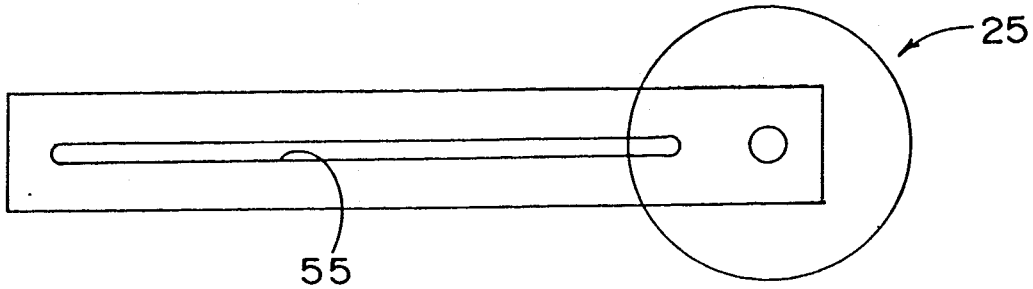
FIG. 5 shows a portion of the structure shown in FIGS. 3 and 4.
Figure 7:
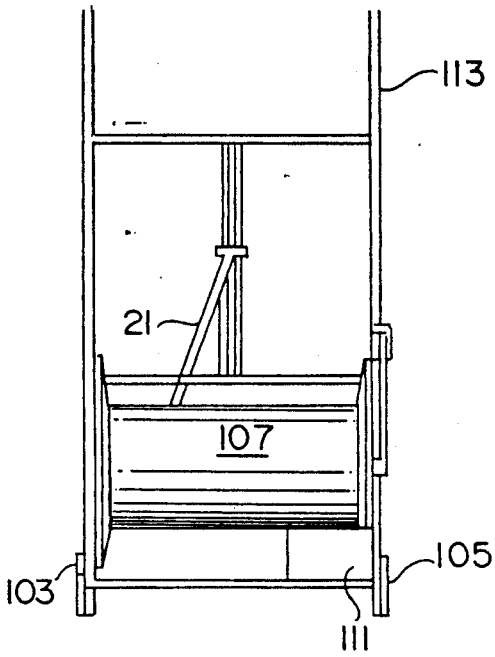
FIG. 7 shows a front view of the boom device.
Figure 6:
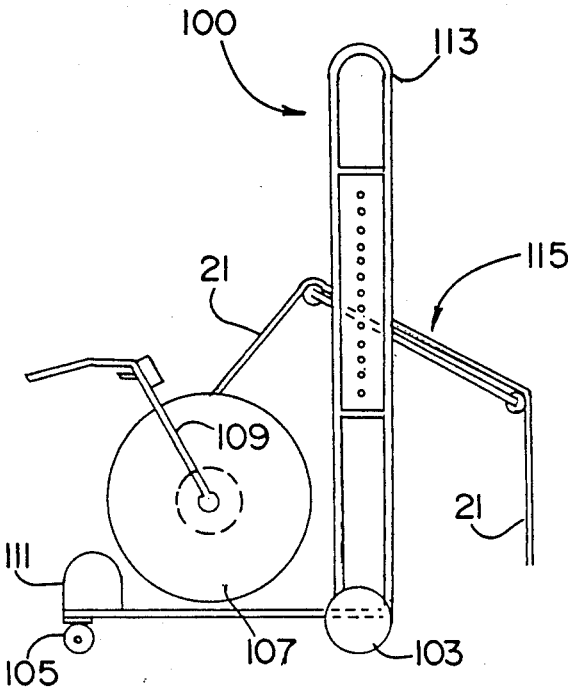
FIG. 6 shows a side view of the boom device of the present invention.
Figure 8:
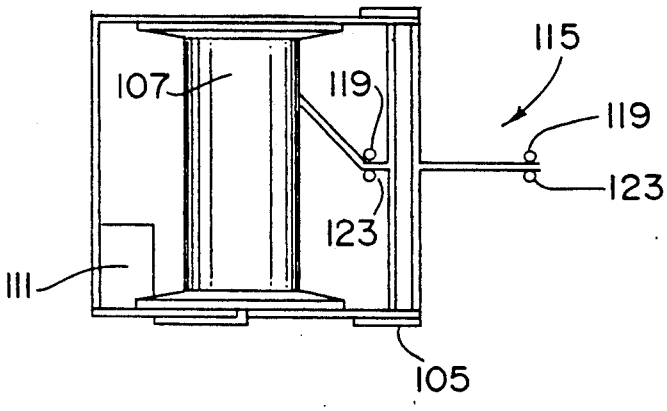
FIG. 8 shows a top view of the boom device.

With particular reference to FIGS. 3, 4 and 5, the wheel assemblies 25 include a tubular member 41 fixed to the tubular member 15, and a hollow chamber 43 therein in which is slidably mounted a further tubular member 45 to which a wheel 47 is rotatably mounted on the pivot 49.

The tubular member 45 has a pin 51 fixed therewithin to provide a surface of engagement for the compression spring 53 best seen in FIG. 3 as contained within the chamber 43 between the end wall 42 thereof and the pin 51. As best seen in FIG. 5, the tubular member 45 has a guide slot 55 which allows reciprocation of the tubular member 45 with respect to the tubular member 41 without allowing the tubular member 45 to be removed completely from the chamber 43. A pin 57 seen in FIG. 3 rides in the groove 55 to perform this guiding function.

Thus, the frame device 11 preferably includes two rows of three wheel assemblies with each row including two wheel assemblies 23 and one wheel assembly 25. Thus, when it is desired to use the inventive chute cleaning device 10 within a particular chute (not shown), the wheel assemblies 23, 25 are adjusted so that the wheels 31, 47 will roll on the inner walls of the chute during operation thereof. Of course, if desired, as many wheel assemblies as desired may be circumferentially spaced about the tubular member 15.

Figure 2:
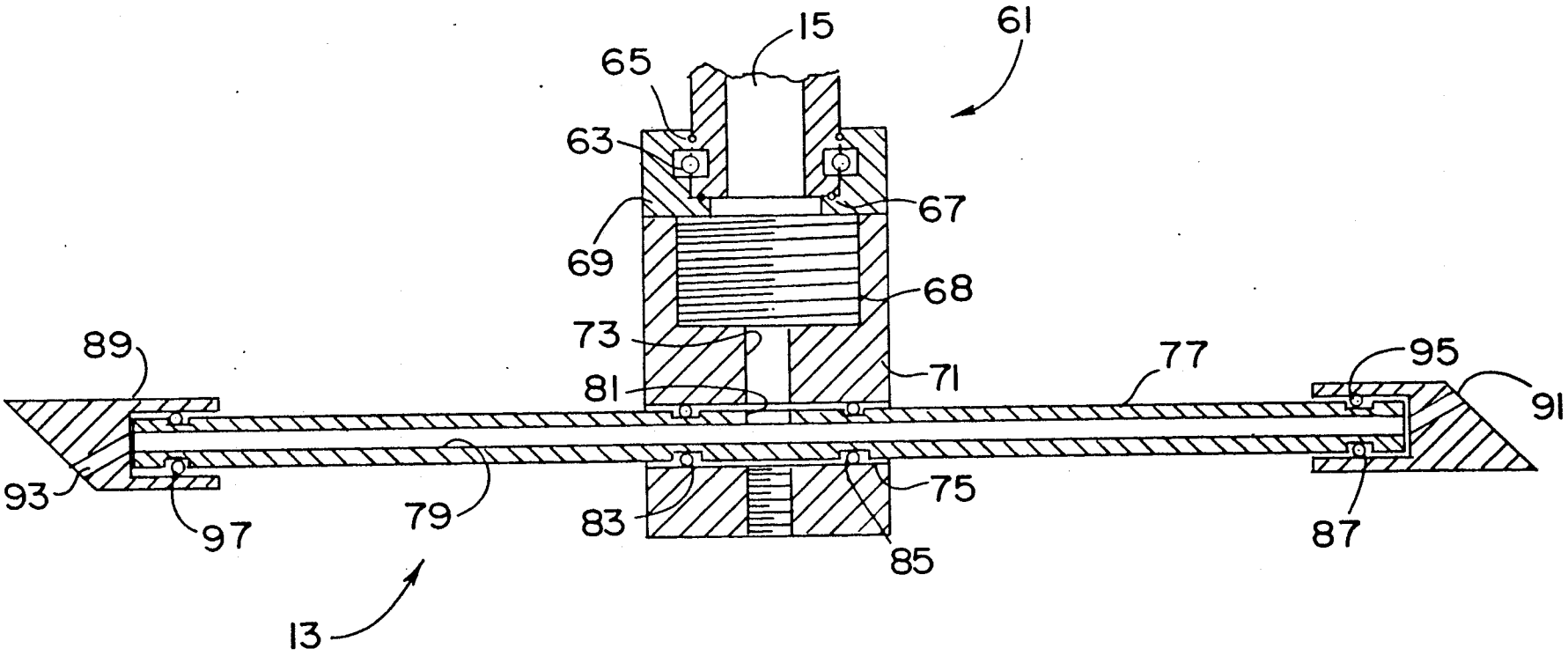
FIG. 2 shows a cross-sectional view of a portion of the structure shown in FIG. 1.

With reference now to FIGS. 1 and 2, it is seen that the tubular member 15 is coupled at a coupling 61 with the rotatable spraying assembly 13. The coupling 61 includes, preferably, a ball bearing 63 and an O-ring 65 allowing rotation of the rotatable spraying assembly 13 with respect to the tubular member 15 without fluid leakage. If desired, a further O-ring 67 may be provided at the end of the tubular member 15.

With particular reference to FIG. 2, it is seen that the rotatable spraying assembly includes a blind bore 68 which is internally threaded to mesh with external threads formed on a plug member 69 forming another portion of the coupling 61.

The rotatable spraying assembly includes a block 71 in which the threaded blind bore 68 is formed. The block 71 also includes an axial flow passage 73 and a transverse bore 75 in which is fixedly inserted the elongated spray bar 77.

The spray bar 77 includes an elongated longitudinal bore 79 as well as a transverse bore 81 which is aligned with the longitudinal bore 73 in the block 71. O-ring seals 83, 85 prevent fluid leakage. At the ends of the spray bar 77, nozzle assemblies 87 and 89 are provided each of which includes an angled outlet orifice 91 and 93 respectively. Respective O-ring seals 95 and 97 inhibit fluid leakage.

As should be understood by those skilled in the art, application of fluid pressure through the tubular member 15, through the bore 73, the bore 81 and the longitudinal passage 79 and then out the nozzles 87 and 89 will cause the spray bar 77 and the block 71 fixedly mounted therewith to rotate due to the angled nature of the orifices 91 and 93. Such rotation will be about the tubular member 15 due to the existence of the ball bearing connection 63. Thus, this rotation will allow complete spraying of the internal walls of the chute in which the chute cleaning device has been suspended.

With reference to FIGS. 6–10, it is seen that the boom device is generally designated by the reference numeral 100 and includes a cart 101 having wheels 103, 105, a drum 107 mounted on the cart 101 for rotation with respect thereto and having a control 109 with electrical circuitry (not shown) designed to control the operation of an electric motor 111 to thereby cause selective rotations of the drum 107 to either pay out or retrieve the flexible fluid conduit 21.

Figure 10:
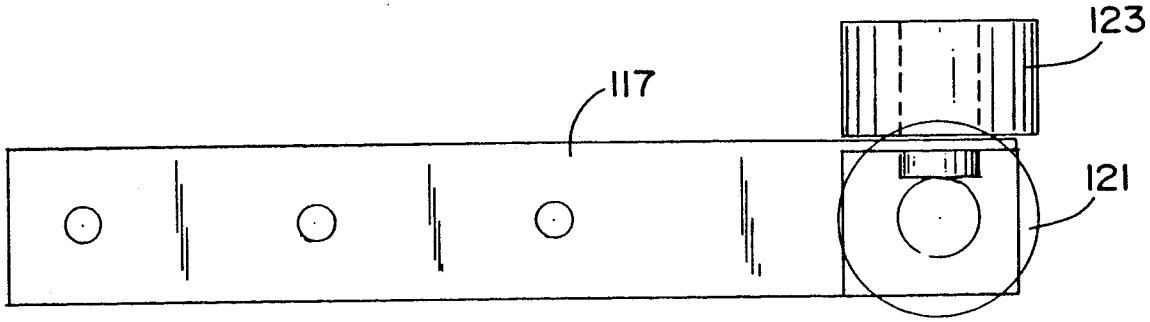
FIG. 10 shows a side view of the structure seen in FIG. 9.
Figure 9:
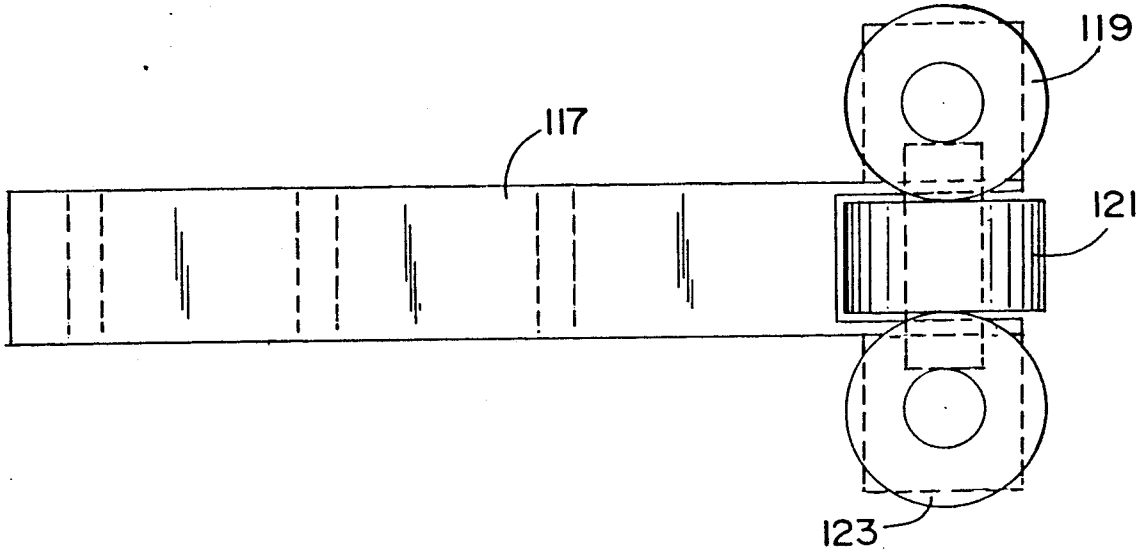
FIG. 9 shows a top view of a portion of the structure seen in FIGS. 6, 7 and 8.

The boom device 100 includes conduit guiding structure including an upright frame portion 113 as well as a guide 115 best seen with reference to FIGS. 9 and 10.

With reference to FIGS. 9 and 10, it is seen that the guide device 115 includes an elongated ramp structure 117 having at each end thereof three pulleys 119, 121 and 123. The pulleys 119 and 123 are rotatably mounted on parallel axes with the axis of rotation of the pulley 121 being perpendicular to that of the pulleys 119 and 123. Thus, the pulleys 119, 121 and 123 act to guidingly engage the flexible fluid conduit 21 on three sides thereof.

From the above description, the operation of the boom device 100 in conjunction with the chute cleaning device 10 should be self-evident.

When it is desired to clean or otherwise treat a chute with liquid spray, the boom device 100 is transported adjacent the chute and the chute cleaning device 10 is inserted into the chute from above and is lowered to the desired elevation therein through operation of the electric motor 111 to turn the drum 107 to pay out the required amount of fluid conduit 21. The fluid conduit 21 is guided by the guiding structure 115.

When the chute cleaning device 10 has arrived at the desired elevation, fluid pressure is applied to the fluid conduit 21 from a source (not shown) as described hereinabove, fluid will flow through the conduit 21, through the tubular member 15, through the coupling 61 and the block 71 and into the spray bar 77 and thence out the nozzles 87 and 89 to cause fluid to be sprayed on the inner walls of the chute while the spray bar and associated structure rotates with respect to the tubular member 15 via the bearing 63.

During rotation of the spray bar 77, a control device 109 may be used to selectively rotate the drum 107 to pay out or retrieve fluid conduit 21 to adjust the elevation of the spray bar 77 within the chute during spraying operations.

In this way, with the chute cleaning device 10 being carefully guided within the chute by careful and appropriate adjustment of the wheel assemblies 23 and 25, effective cleaning or other treatment of the chute may be accomplished.

As such, an invention has been disclosed in terms of a preferred embodiment thereof which fulfills each and every one of the objects of the invention as set forth hereinabove and provides a new and useful chute cleaning device which may be easily transported and controlled in a manner superior to that which is known in the prior art. Of course, various changes modifications and alterations in the teachings of the present invention may be contemplated by those skilled in the art without departing from the intended spirit and scope thereof. As such, it is intended that the present invention only be limited by the terms of the appended claims.

We claim:

1. A boom operated chute cleaning device, comprising:

(a) a frame assembly including a fluid conduit extending therethrough having a first end connected to a source of cleaning fluid;

(b) guide means on said frame assembly for guiding said frame assembly within said chute;

(c) a second end of said fluid conduit having fluidly connected thereto fluid spraying means for spraying cleaning fluid on inner walls of said chute, said fluid spraying means comprising an elongated spray bar centrally mounted on a rotatable fluid coupling, opposed ends of said spray bar having angled nozzles whereby flow of cleaning fluid from said nozzles causes said spray bar to rotate;

(d) said source of cleaning fluid comprising a boom assembly carrying a length of flexible fluid pipe on a rotary drum with one end of said flexible fluid pipe coupled to said first end of said fluid conduit and another end of said flexible fluid pipe connected to a container of cleaning fluid;

(e) said guide means comprising a plurality of rods extending outwardly from said frame assembly in different directions within a common plane, each said rod having a wheel rotatably mounted at an end thereof remote from said frame assembly, said wheels being adapted to roll on said inner walls, at least one of said rods being adjustable in length and lockable after adjustment to a desired length, at least another one of said rods including telescoping structure and biasing means for biasing said at least one of said rods in a direction of extension and into biased engagement with said inner walls.

2. The invention of claim 1, wherein said rotatable fluid coupling includes a ball bearing.

3. The invention of claim 1, wherein said nozzles are angularly adjustable with respect to said spray bar.

4. The invention of claim 1, wherein said boom assembly further includes a guiding device adjacent said drum which guides said flexible fluid pipe from said drum into said chute.

5. The invention of claim 4, wherein said boom assembly includes a wheeled cart, and further wherein the position of said guiding device is adjustable.

* * * * *